US012501958B2

(12) United States Patent
Worple

(10) Patent No.: US 12,501,958 B2
(45) Date of Patent: Dec. 23, 2025

(54) HARD HAT WITH IMPACT PROTECTION MATERIALS

(71) Applicant: Milwaukee Electric Tool Corporation, Brookfield, WI (US)

(72) Inventor: Joseph R. Worple, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/467,434

(22) Filed: Sep. 14, 2023

(65) Prior Publication Data

US 2024/0081459 A1 Mar. 14, 2024

Related U.S. Application Data

(63) Continuation of application No. PCT/US2023/032194, filed on Sep. 7, 2023.

(60) Provisional application No. 63/374,988, filed on Sep. 8, 2022.

(51) Int. Cl.

| | |
|---|---|
| ***A42B 3/06*** | (2006.01) |
| ***A42B 3/04*** | (2006.01) |
| *A42B 3/08* | (2006.01) |
| *A42B 3/14* | (2006.01) |

(52) U.S. Cl.
CPC ..... *A42B 3/064* (2013.01); *A42B 3/0406* (2013.01); *A42B 3/08* (2013.01); *A42B 3/14* (2013.01)

(58) Field of Classification Search
CPC ..... A42B 3/064; A42B 3/0406; A42B 3/08; A42B 3/14
USPC ..... 2/411
See application file for complete search history.

(56) References Cited

U.S. PATENT DOCUMENTS

| | | | | |
|---|---|---|---|---|
| 7,608,314 | B2 | 10/2009 | Plant | |
| 9,375,041 | B2 | 6/2016 | Plant | |
| 9,516,910 | B2 * | 12/2016 | Szalkowski | A42B 3/127 |
| 10,408,294 | B2 | 9/2019 | Plant | |
| 11,013,287 | B2 * | 5/2021 | Daburn | A42B 3/185 |
| 11,746,849 | B2 | 9/2023 | Plant | |
| 2012/0106089 | A1 * | 5/2012 | Hsu | H05K 7/20509 361/721 |
| 2016/0037852 | A1 | 2/2016 | Leon | |
| 2018/0184732 | A1 | 7/2018 | Plant | |

(Continued)

FOREIGN PATENT DOCUMENTS

| | | |
|---|---|---|
| WO | WO2017/033022 | 3/2017 |
| WO | WO2021/000052 | 1/2021 |

OTHER PUBLICATIONS

International Search Report and Written Opinion for International Application No. PCT/US2023/032194 dated Dec. 29, 2023, 12 pages.

(Continued)

*Primary Examiner* — Timothy K Trieu
(74) *Attorney, Agent, or Firm* — Reinhart Boerner Van Deuren s.c.

(57) ABSTRACT

A hard hat including an outer shell, a linear impact absorbing material, and a rotational impact absorbing material is constructed of materials designed to provide protection to a wearer in extreme environmental conditions and under impact. In one embodiment, the rotational impact absorbing material is formed from a strain rate sensitive material in which the rigidity of the material increases under an impact.

21 Claims, 14 Drawing Sheets

(56) References Cited

U.S. PATENT DOCUMENTS

| | | | | |
|---|---|---|---|---|
| 2020/0282655 | A1 | 9/2020 | Plant et al. | |
| 2020/0359728 | A1 | 11/2020 | Plant | |
| 2021/0106089 | A1 | 4/2021 | Hyma | |
| 2021/0352992 | A1* | 11/2021 | Worple | A42B 3/064 |
| 2022/0015488 | A1* | 1/2022 | Adams | A42B 3/14 |

OTHER PUBLICATIONS

Milwaukee Tool, Bolt White Safety Helmet (USA)—Type 2, Class E, https://www.milwaukeetool.com/Products/48-73-1301, believed to be commercially available at least by May 23, 2022, Retrieved on Sep. 13, 2023, 8 pages.

Guardiosafety, Guardio Armet, https://guardiosafety.com/en/produkt/armet/, believed to be commercially available at least by May 23, 2022, Retrieved on Sep. 13, 2023, 12 pages.

Kask Safety, Zenith, https://www.kask-safety.com/en/helmets/zenith/zenith_24_17.htm, believed to be commercially available at least by May 23, 2022, Retrieved on Sep. 13, 2023, 12 pages.

Studson, SHK-1 Non-Vented https://studson.com/products/shk-1-non-vented, believed to be commercially available at least by May 23, 2022, Retrieved on Sep. 13, 2023, 6 pages.

Ergodyne, Skullerz 8974 Safety Helmet—Type 1, Class E, https://www.ergodyne.com/skullerz-8974-safety-helmet-class-e, believed to be commercially available at least by May 23, 2022, Retrieved on Sep. 13, 2023, 4 pages.

Centurion, Nexus Extreme Mips, https://centurionsafety.eu/product/nexus-extreme-mips/, believed to be commercially available at least by May 23, 2022, Retrieved on Sep. 13, 2023, 13 pages.

Bland et al., Star Methodology for Bicycle Helmets, Virginia Tech, May 30, 2018, 6 pages.

Siegkas et al., The traumatic brain injury mitigation effects of a new viscoelastic add-on liner, Scientific Reports, Mar. 5, 2019, 10 pages.

* cited by examiner

HARD HAT WITH IMPACT PROTECTION MATERIALS

CROSS-REFERENCE TO RELATED PATENT APPLICATION

The present application is a continuation of International Application No. PCT/US2023/032194 filed on Sep. 7, 2023, which claims the benefit of and priority to U.S. Provisional Application No. 63/374,988 filed on Sep. 8, 2022, which is incorporated herein by reference in its entirety.

BACKGROUND OF THE INVENTION

The present invention relates generally to the field of protective equipment. The present invention relates specifically to various construction/work hard hat designs constructed with materials to provide added protection to a user's head from impacts that could otherwise impart harmful rotational acceleration to a wearer's head (i.e., rotational impact, and/or combined linear and rotational impact).

SUMMARY OF THE INVENTION

One embodiment of the invention relates to a protective work helmet. The work protective helmet includes an outer shell. The outer shell includes an exterior surface, an interior surface defining a cavity sized to receive a head of a user, and a crown portion. The crown portion is configured to cover part of the head of the user. A bottom segment of the crown portion defines a lower circumference extending along the exterior surface of the outer shell. The outer shell further includes a brim extending radially outward from a portion of the lower circumference and a front mounting ridge. The front mounting ridge is configured to couple an accessory to the protective work helmet. The protective work helmet further includes a linear impact absorbing material located within the outer shell and a rotational impact absorbing material located within the outer shell. The rotational impact absorbing material is a strain rate sensitive material in which a rigidity of the rotational impact absorbing material increases upon impact.

Another embodiment of the invention relates to a protective work helmet. The protective work helmet includes an outer shell formed from a rigid material. The outer shell includes an exterior surface, an interior surface defining a cavity sized to receive a head of a user, and a crown portion. The crown portion is configured to cover part of the head of the user. A bottom segment of the crown portion defines a lower circumference extending along the exterior surface of the outer shell. The outer shell further includes a brim extending radially outward from a portion of the lower circumference. The protective work helmet further includes a polymer foam insert located within the outer shell and having a thickness. The polymer foam insert includes an outer surface facing the interior surface of the outer shell and an inner surface facing inward. The protective work helmet includes a rotational impact absorbing liner coupled to the inner surface of the polymer foam insert. The rotational impact absorbing liner is a strain rate sensitive material in which the rigidity of the rotation impact absorbing liner increases upon impact.

Another embodiment of the invention relates to a protective work helmet. The protective work helmet includes an outer shell. The outer shell includes an exterior surface, an interior surface defining a cavity sized to receive a head of a user, and a crown portion. The crown portion is configured to cover part of the head of the user. A bottom segment of the crown portion defines a lower circumference extending along the exterior surface of the outer shell. The outer shell further includes a brim extending radially outward from a portion of the lower circumference and a front mounting ridge. The front mounting ridge is configured to couple to an accessory to the protective work helmet. The protective helmet further includes an impact absorbing insert. The impact absorbing insert includes a linear impact absorbing material positioned within the outer shell and a rotational impact absorbing material positioned within the outer shell. The impact absorbing insert is configured to provide a peak rotational acceleration under the Rheon Test Method less than a maximum peak rotational acceleration. In specific embodiments, the impact absorbing insert is configured to provide a peak rotational acceleration under the Rheon Test Method less than 7000 radians/seconds$^2$.

Another embodiment of the invention relates to a protective work helmet. The protective work helmet includes an outer shell. The outer shell includes an exterior surface, an interior surface defining a cavity sized to receive a head of a user, and a crown portion. The crown portion is configured to cover part of the head of the user. A bottom segment of the crown portion defines a lower circumference extending along the exterior surface of the outer shell. The outer shell further includes a brim extending radially outward from a portion of the lower circumference and a front mounting ridge. The front mounting ridge is configured to couple an accessory to the protective work helmet. The protective helmet further includes an impact absorbing insert. The impact absorbing insert includes a linear impact absorbing material positioned within the outer shell and a rotational impact absorbing material positioned within the outer shell. The impact absorbing insert is configured to provide a peak rotational acceleration under the Virginia Tech Test Method less than a maximum peak rotational acceleration. In specific embodiments, the impact absorbing insert is configured to provide a peak rotational acceleration under the Virginia Tech Test Method less than 5500 radians/seconds$^2$. In such embodiments, the peak rotational acceleration under the Virginia Tech Test Method is greater than 4000 radians/seconds$^2$.

Another embodiment of the invention relates to a protective work helmet. The protective work helmet includes an outer shell. The outer shell includes an exterior surface, an interior surface defining a cavity sized to receive a head of a user, and a crown portion. The crown portion is configured to cover part of the head of the user. A bottom segment of the crown portion defines a lower circumference extending along the exterior surface of the outer shell. The outer shell further includes a brim extending radially outward from a portion of the lower circumference and a front mounting ridge. The front mounting ridge is configured to couple an accessory to the protective work helmet. The protective helmet further includes an impact absorbing insert. The impact absorbing insert includes a linear impact absorbing material positioned within the outer shell and a rotational impact absorbing material positioned within the outer shell. The impact absorbing insert is configured to provide a peak rotational acceleration under the Rheon Test Method less than a maximum peak rotational acceleration. In specific embodiments, the impact absorbing insert is configured to provide a peak rotational acceleration under the Rheon Test Method less than 7000 radians/seconds$^2$ and a peak linear acceleration under the Rheon Test Method less than 70 meters/seconds$^2$.

Another embodiment of the invention relates to a protective work helmet. The protective work helmet includes an outer shell. The outer shell includes an exterior surface, an interior surface defining a cavity sized to receive a head of a user, and a crown portion. The crown portion is configured to cover part of the head of the user. A bottom segment of the crown portion defines a lower circumference extending along the exterior surface of the outer shell. The outer shell further includes a brim extending radially outward from a portion of the lower circumference and a front mounting ridge. The front mounting ridge is configured to couple an accessory to the protective work helmet. The protective helmet further includes an impact absorbing insert. The impact absorbing insert includes a linear impact absorbing material positioned within the outer shell and a rotational impact absorbing material positioned within the outer shell. The impact absorbing insert is configured to provide a peak rotational acceleration under the Virginia Tech Test Method less than a maximum peak rotational acceleration. In specific embodiments, the impact absorbing insert is configured to provide a peak rotational acceleration under the Virginia Tech Test Method between 4000 radians/seconds$^2$ and 55000 radians/seconds$^2$ and a peak linear acceleration under the Virginia Tech Test Method less than 145 meters/seconds$^2$.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
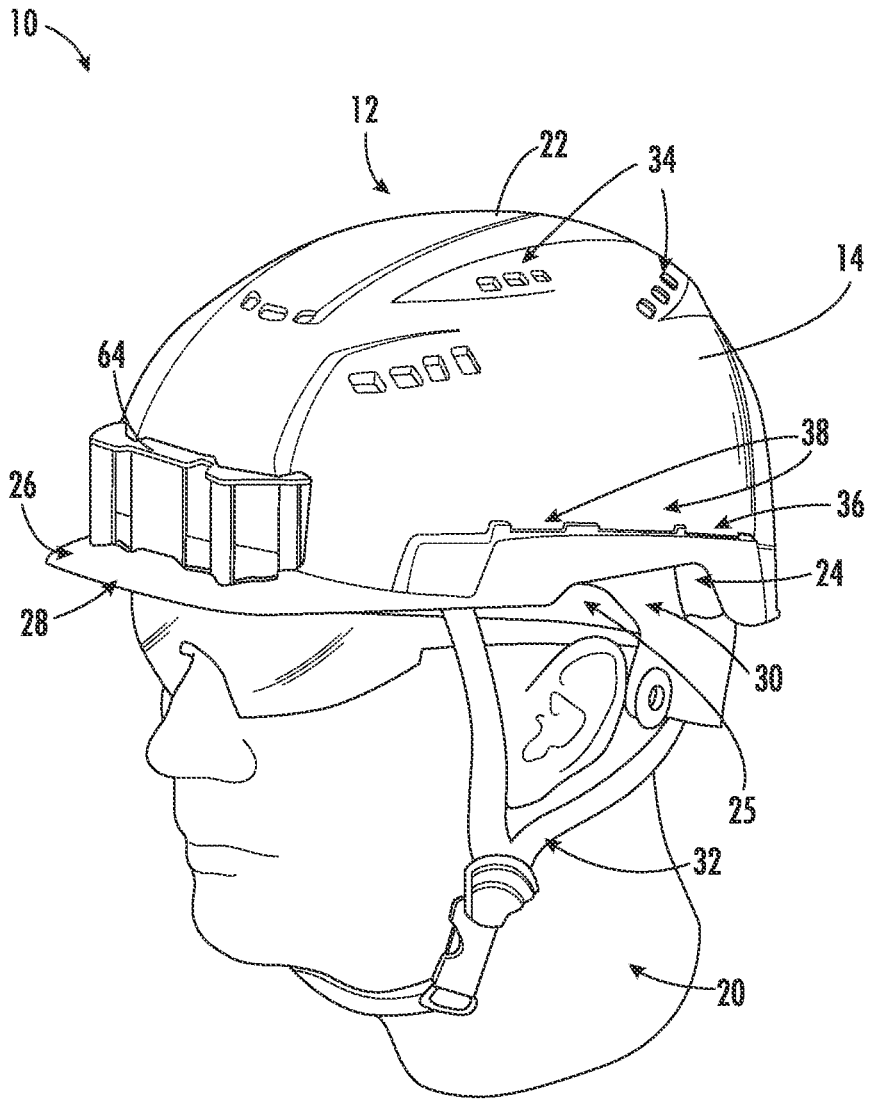
FIG. 1 is a perspective view of a hard hat on the head of a wearer, according to an exemplary embodiment.

Referring generally to the figures, various embodiments of a protective work/construction helmet, shown as a hard hat are shown. Various embodiments of the hard hat discussed herein include various designs and materials that provide an improved ability to absorb impacts (e.g., falling objects, lateral impact of objects, impact from tripping/falling) and therefore are believed to reduce the risk and/or likelihood of head injuries (i.e., concussions, traumatic brain injuries, skull fractures, cuts, bruises, etc.) of the type that may be suffered by a worker on a jobsite.

As will be generally understood, many conventional hard hats are designed to provide impact protection for specific portions of the head during specific types of impacts. For example, ANSI Type I hard hats protect the top of the head, and ANSI Type II hard hats are designed to provide top and side impact protection. Many conventional hard hats designed with structures and/or materials to provide protection against impacts with rotational acceleration fail to provide comparable performance in terms of linear acceleration absorption. Similarly, many conventional hard hats designed with structures and/or materials to provide linear acceleration absorption fail to provide comparable performance in terms of rotational acceleration absorption. Applicant believes that, because of various design demands for a work/construction environment, prior hard hat designs have failed to provide both high levels of rotational impact protection and/or combined linear and rotational impact performance.

Applicant believes the hard hat designs discussed herein provide improved impact protection due to the reduction of peak rotational acceleration alone or combined with linear acceleration during impact such that the risk and/or likelihood or injury to the hard hat wearer is reduced. In various embodiments, the hard hat includes an outer shell and an impact absorbing insert or layer. As will be discussed in greater detail below, the impact absorbing insert or layer may include more than one component or material, such as a linear impact absorbing layer combined with a rotational impact absorbing layer that provides for reduction of rotational acceleration and/or reduction of combined linear and rotational acceleration during impact.

Applicant believes the rotational impact absorbing material that provides rotational impact protection described herein provides a number of advantages compared to current structures and/or materials used within protective helmets to reduce rotational acceleration. For example, in specific embodiments the rotational impact absorbing material is a strain rate sensitive material in which the rigidity of the rotational impact absorbing material increases upon impact.

As will be discussed in more detail below, Applicant's test data shows that the designs discussed herein provide a hard hat with improved rotational impact performance compared to conventional hard had impact materials that provide for rotational energy absorption based purely on material geometry or that rely upon translation and/or sliding of adjacent impact layers to absorb rotational acceleration.

In addition to providing improved rotational impact performance, Applicant believes that the hard hat designs discussed herein provide a hard hat that is potentially reusable following impact. In various designs discussed herein, the rotational impact absorbing layer absorbs rotational energy in a manner that does not damage the material, and thus, results in a hard hat that is potentially reusable following impact and therefore capable of undergoing repeated impacts. Specifically, when the rotational impact absorbing layer undergoes compression, the rotational impact absorbing material stays within the elastic deformation range compared to current protective helmets that have impact materials that plastically deform causing such impact materials to have reduced impact performance following the first impact.

Further, Applicant believes that hard hats discussed herein do not require a large slip plane and/or displacement to absorb impact energy unlike conventional hard hats that include Multi-directional Impact Protection Systems ("MIPS") for rotational impact protection. As will be discussed in greater detail below, Applicant has found the hard hat designs with a rotational impact layer as discussed herein can reduce the rotational acceleration experienced by the helmet wearer with less translational and/or sliding movement of the rotational layer than conventional hard hats with rotational impact protection. Specifically, the hard hat designs with a rotational impact layer discussed herein reduce the rotational acceleration experienced by the helmet wearer with less translational and/or sliding movement of the rotational layer than the 10-15 mm of translating or sliding movement allowed by helmets including MIPS structures.

As will be generally understood, many conventional hard hats are designed to meet a variety of global performance standards (e.g., ANSI standards ANSI Z89.1, EN397, EN14052, EN1292, AS-ANZ 1801, CSA Z94.1, etc.) and wearer demands unique to a construction or work environment. These standards and wearer demands provide for different requirements than other types of protective helmets (bike, football, race car, etc.) that attempt to reduce the effects of a rotational impact on a wearer's head. Due to the extreme environmental conditions faced by hard hat wearers (weather, temperature, etc.), Applicant believes the hard hat designs discussed herein are capable of improved impact performance over a larger range of conditions. For example, the hard hat designs discussed herein are capable of improved impact performance up to −30° C. a temperature condition unlikely to be faced by other types of protective helmets. Similarly, because wearers in a work environment often wear the hard hat for long periods of time (e.g., signification portions of a work day), design aspects such as weight and comfort are important factors. In addition, the hard hat designs discussed herein also meet various work place requirements such as providing for mounting locations for accessories used on a job site.

Referring to FIG. 1, a perspective view of a protective work or construction helmet, shown as hard hat 10, is shown according to an exemplary embodiment. Hard hat 10 includes an outer shell 12. In a specific embodiment, outer shell 12 is formed from a rigid material, such as a rigid polymer material. In various specific embodiments, outer shell 12 is formed from one of high density polyethylene (HDPE), acrylonitrile-butadine-styrene (ABS), polycarbonate (PC), polycarbonate/acrylonitrile-butadine-styrene (PC-ABS), and polypropylene (PP). Outer shell 12 includes an exterior surface 14 and an interior surface 16 (see e.g., FIGS. 2-3). Interior surface 16 defines a cavity 18 (see e.g., FIG. 2) sized to receive a head of a user and/or wearer 20. Outer shell 12 includes a crown portion 22 and a bottom segment 24 defining a lower circumference of hard hat 10. In various embodiments, a brim 26 extends radially outward from a portion of the lower circumference. In a specific embodiment, brim 26 extends radially outward from the front 28 of hard hat 10 and specifically outer shell 12.

Hard hat 10 includes a suspension system 30 and a chin strap 32 to support and secure hard hat 10 to the wearer's 20 head. Outer shell 12 further includes a plurality of apertures or vents 34. Vents 34 extend through outer shell 12 providing fluid communication between cavity 18 and the ambient air proximate to exterior surface 14 of outer shell 12. Outer shell 12 further includes recess 25 positioned between front 28 and rear 68 (see e.g., FIG. 4) of hard hat 10 proximate to the ears of wearer 20. In a specific embodiment, recess 25 extends a height above a portion of bottom segment 24 proximate to front 28 and/or rear 68 of hard hat 10.

As will be discussed in greater detail below, various embodiments include one or more mounting ridges configured to couple to and/or support hard hat accessories. A side accessory support ridge or auxiliary mounting ridge 36 is coupled to a lateral side of outer shell 12 along the bottom segment 24. Auxiliary mounting ridge 36 includes a first end and a second end opposing the first end. A plurality of apertures or slots 38 are positioned along auxiliary mounting ridge 36 between the first end and the second end. Slots 38 are configured to receive a coupling mechanism, such as clips, or a portion of a hard hat accessory to couple the accessory to outer shell 12. Auxiliary mounting ridge 36 supports accessories for hard hat 10, such as ear muffs, tool or eyeglass holders, lamp supports, face shields, and/or reflectors, etc.

In various hard hat designs discussed herein, the impact absorbing portion absorbs rotational energy in a manner that does not damage the impact absorbing portion, allowing the hard hat to be potentially reusable following impact and therefore capable of undergoing repeated impacts. For example, when the rotational impact absorbing layer undergoes compression, the rotational impact absorbing material stays within the elastic deformation range.

Figure 2:
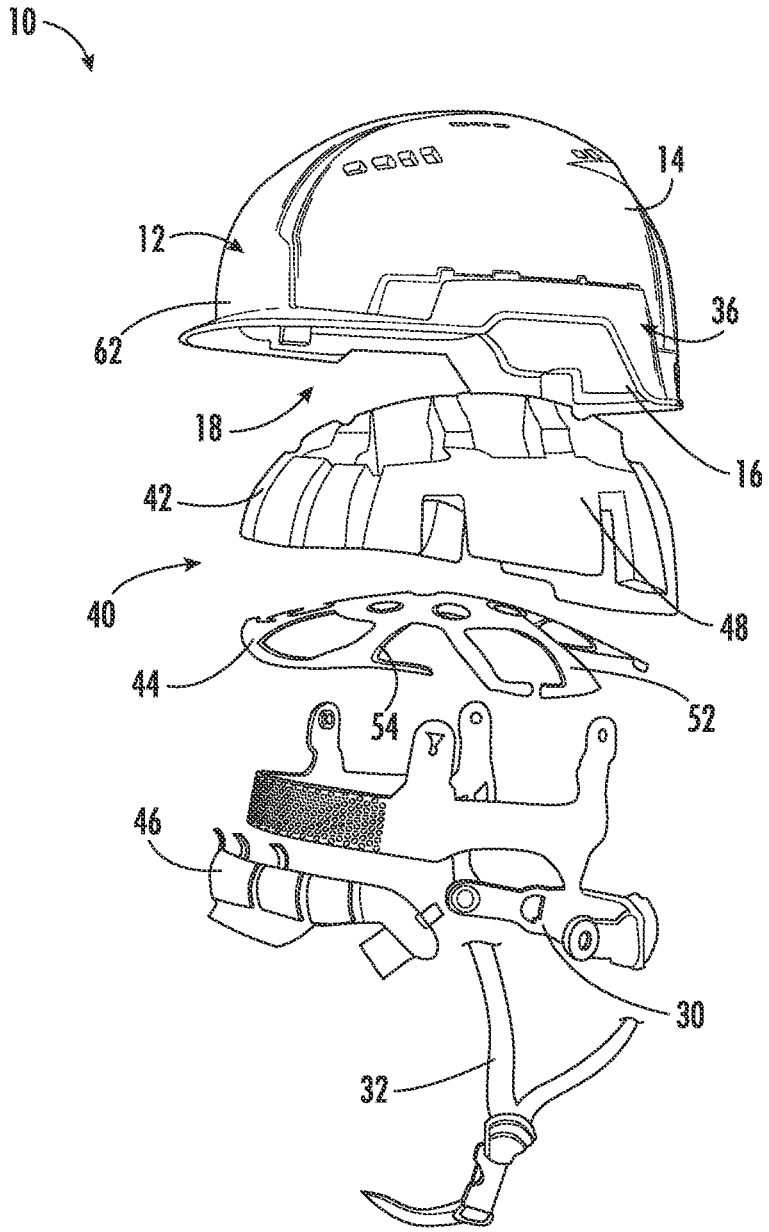
FIG. 2 is an exploded view of the hard hat of FIG. 1, according to an exemplary embodiment.

Referring to FIG. 2, an exploded view of a hard hat 10 is shown according to an exemplary embodiment. Hard hat 10 includes an impact absorbing portion, shown as impact absorbing insert 40, supported within outer shell 12 and specifically within cavity 18. In general, the impact absorbing insert discussed herein includes a first portion or layer that provides for linear acceleration absorption and a second portion that provides rotational impact absorption. In the specific embodiment shown, impact absorbing insert 40 includes the first portion, shown as a linear impact absorbing layer 42, and the second portion, shown as a rotational impact absorbing layer or liner 44. In some embodiments, hard hat 10 includes various layers of padding 46 to provide increased comfort to the wearer. In a specific embodiment, padding 46 is included along interior surface 16 proximate the front 28 of hard hat 10.

Figure 3:
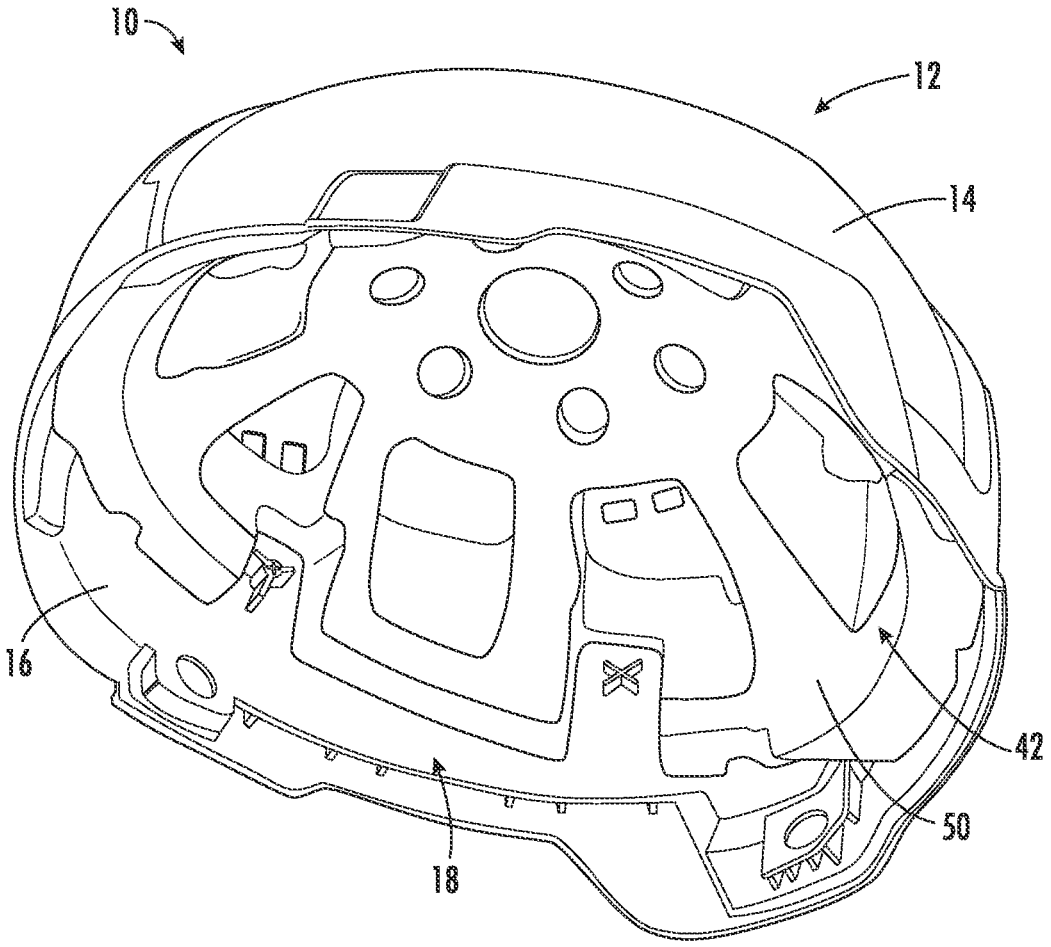
FIG. 3 is a perspective view from below of the hard hat of FIG. 1 with a portion of the impact absorbing insert, a suspension system, and a chin strap removed, according to an exemplary embodiment.

Referring to FIG. 3, a perspective view from below of the hard hat 10 with linear impact absorbing layer 42 is shown, according to an exemplary embodiment. Linear impact absorbing layer 42 includes an outer surface 48 facing interior surface 16 of outer shell 12 and an inner surface 50 facing inward (i.e., toward the hard hat wearer). Rotational impact absorbing liner 44 is coupled to the inner surface 50 of the linear impact absorbing layer 42. Rotational impact absorbing liner 44 includes an outer surface 52 (see e.g., FIG. 2) facing inner surface 50 of linear impact absorbing layer 42 and an inner surface 54 facing inward (i.e., toward the hard hat wearer). In a specific embodiment, linear impact absorbing layer 42 is formed from a polymer foam material. In a specific embodiment, linear impact absorbing layer 42 is formed from expanded polystyrene (EPS).

In various embodiments, rotational impact absorbing liner 44 is a strain rate sensitive material meaning the properties of rotational impact absorbing liner 44 change with increasing strain rate. Specifically, in such embodiments, rotational impact absorbing liner 44 is a material in which the rigidity of the rotational impact absorbing material increases under impact. Specifically, the impact absorbing material a first distance or close to the impact location has greater engagement than impact absorbing material a second distance or farther away from the impact location. Applicant believes the entire impact absorbing liner 44 where touching or engaging a user's head is engaged during impact in compression, shear, or a combination of compression and shear based on the location of impact.

In some embodiments, rotational impact absorbing liner 44 is a dilatant material (shear thickening material). In various embodiments, rotational impact absorbing liner 44 includes a plurality of cells. In a specific embodiment, the cells of the impact absorbing liner have an anisotropic geometry such that the material has a different response and behavior to mechanical deformation in all three directions (X, Y, Z).

In a specific embodiment, the rotational impact absorbing liner 44 is a unitary piece of polymer material. In other embodiments, the rotational impact absorbing liner 44 may be formed from multiple pieces of material (i.e., 2 pieces, 3 pieces, etc.). Applicant believes a unitary rotational impact absorbing liner provides, improved ease of product assembly, reduced manufacturing costs, more consistent performance regardless of impact location, an increase in the amount of absorbing storage material within the system (outer shell 12, linear impact absorbing layer 42, rotational impact absorbing liner 44) improved sweat management properties.

As previously discussed, Applicant believes the hard hat designs discussed herein are capable of improved impact performance over a larger range of conditions (i.e., up to −30° C., signification portions of a work day, etc.) different from requirements of other types of protective helmets (bike, football, race car, etc.) that attempt to reduce the effects of a rotational impact on a wearer's head. Additionally, the hard hat designs discussed herein also meet various work place requirements such as providing for mounting locations (i.e., front, rear sides) for accessories used on the job site.

Figure 4:
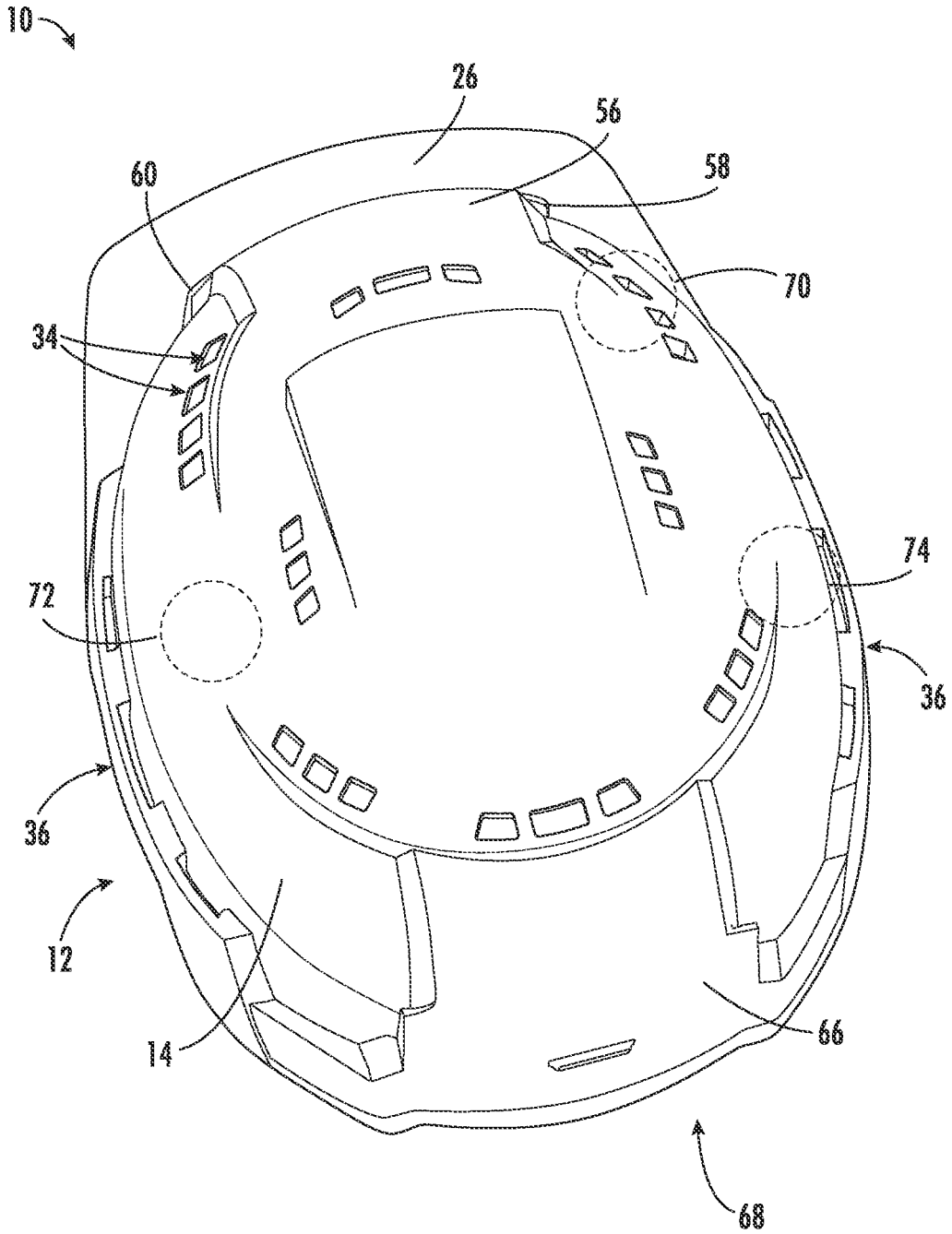
FIG. 4 is a perspective view from above of the hard hat of FIG. 1, according to an exemplary embodiment.

Referring to FIG. 4, a perspective view from above of the hard hat 10 is shown, according to an exemplary embodiment. An additional side accessory support ridge or auxiliary mounting ridge 36 is coupled to a lateral side of outer shell 12 along the bottom segment 24. Hard hat 10 further includes a front mounting ridge 56 positioned on the front 28 of outer shell 12. Front mounting ridge includes a right edge 58 protruding outwardly from the front mounting ridge 56 and a left edge 60 opposing the right edge and protruding outwardly from the front mounting ridge 56. In a specific embodiment, front mounting ridge 56 includes a detent 62 (see e.g., FIG. 2) positioned between the right edge 58 and the left edge 60 and configured to interface with an accessory mounting bracket 64 (see e.g., FIG. 1) and/or an accessory. The right edge 58 and left edge 60 of the front mounting ridge 56 each extend toward the bottom segment 24 of the outer shell 12. The right edge 58 and left edge 60 each include a portion with an increased width as the right edge 58 and left edge 60 approach the bottom segment and/or the brim 26.

In various embodiments, the hard hat 10 includes a second or rear mounting ridge 66 located along at the rear 68 of the hard hat 10. This allows a user to attach accessories and/or accessory mounting brackets to both the front 28 and rear 68 of hard hat 10. Rear mounting ridge 66 is substantially the same as front mounting ridge 56.

As will be discussed in greater detail below, impact testing was performed on hard hat 10. The data collected from the impact testing includes data from multiple impact location sites. Specifically, data was collected at a front right location 70, a side left location 72 and a back side right 74 locations.

Figure 5:
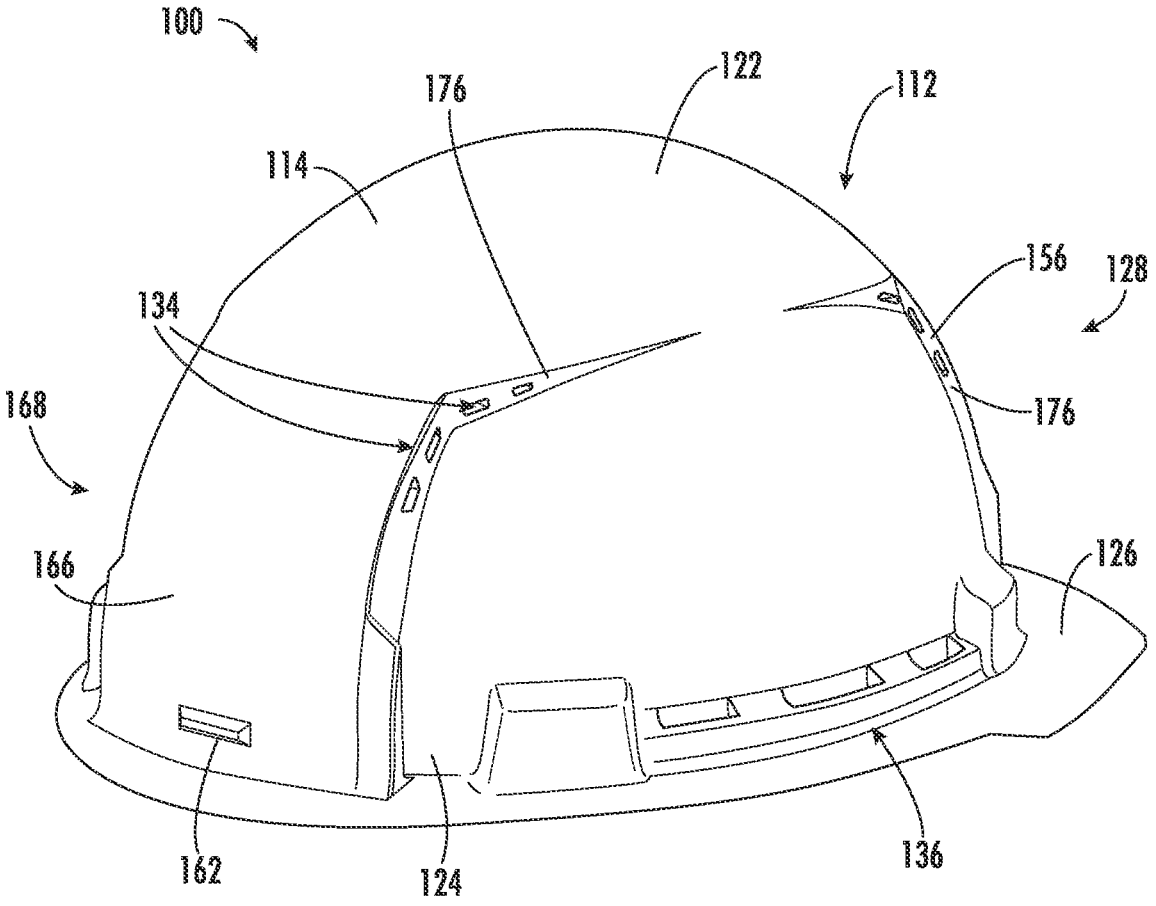
FIG. 5 is a perspective view from the rear of a hard hat, according to another exemplary embodiment.
Figure 6:
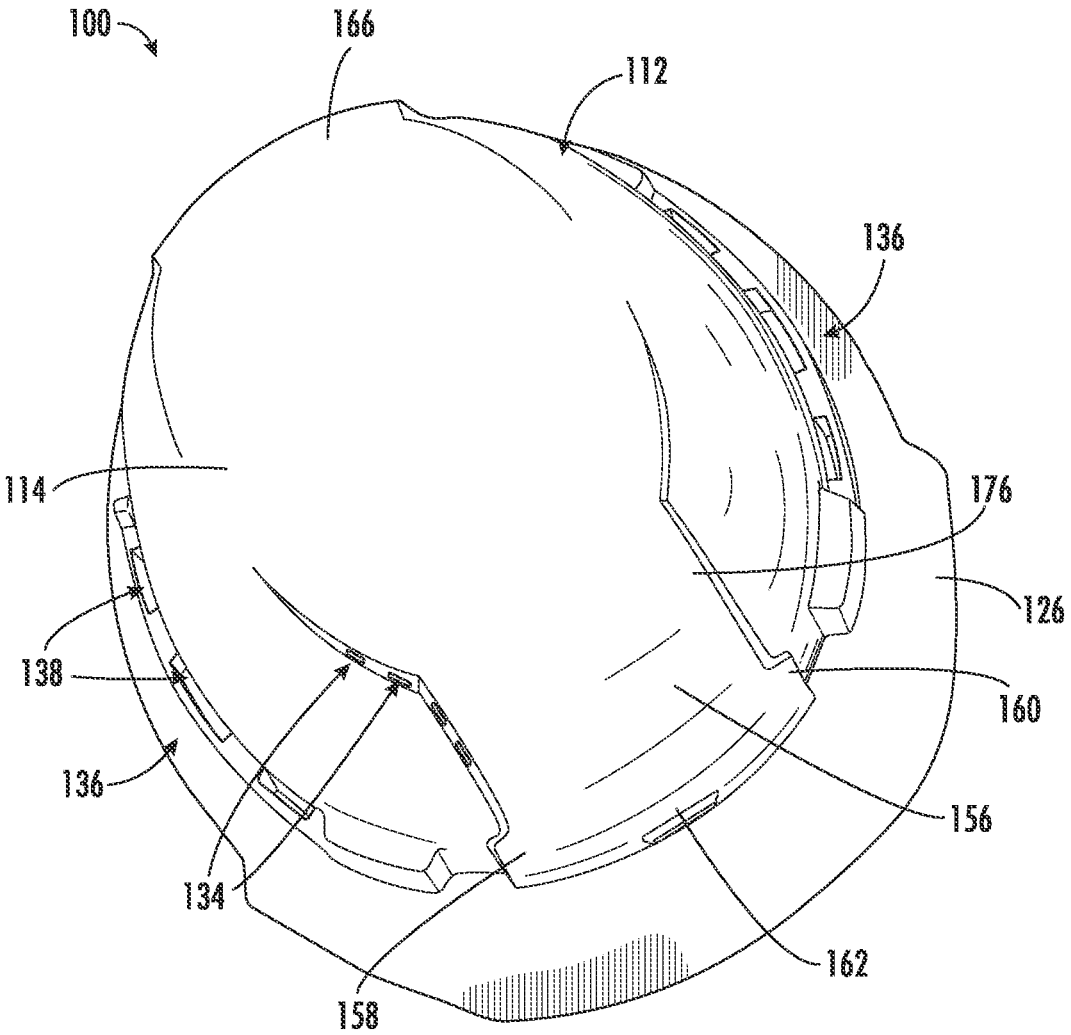
FIG. 6 is a perspective view from above of the hard hat of FIG. 5, according to an exemplary embodiment.

Referring to FIGS. 5-6, perspective views of a hard hat 100 are shown according to another exemplary embodiment. Hard hat 100 can be utilized with impact absorbing insert 40, suspension system 30 and chin strap 32. Hard hat 100 is substantially the same as hard hat 10 except for the differences discussed herein and the components of hard hat 100 have been given the same reference number plus 100.

Hard hat 100 does not include a recess proximate to the ear of the wearer (see e.g., 25 in FIG. 1). Each mounting ridge 156, 166 includes a pair of opposing planar surfaces 176 extending from the crown 122 toward the bottom segment 124 of hard hat 100. A plurality of vents 134 are positioned on the planar surfaces 176. A width of the planar surfaces 176 increases as the planar surfaces 176 approach bottom segment 124. Additionally, hard hat 100 has a different size and/or shape compared to hard hat 10.

Figure 7:
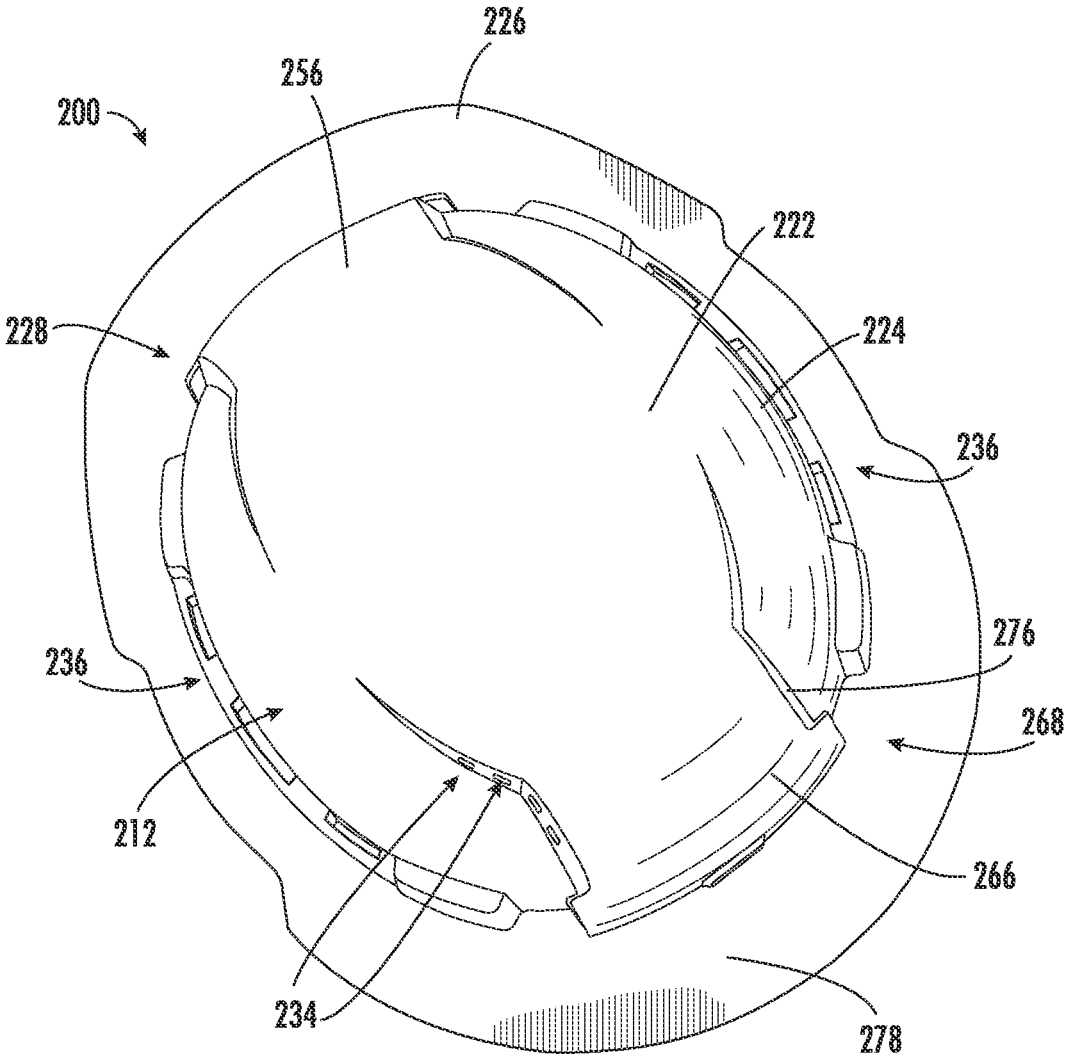
FIG. 7 is a is a perspective view from above of a hard hat, according to another exemplary embodiment.

Referring to FIG. 7, a perspective view of a hard hat 200 is shown according to another exemplary embodiment. Hard hat 200 can be utilized with impact absorbing insert 40, suspension system 30 and chin strap 32. Hard hat 200 is substantially the same as hard hat 100 except for the differences discussed herein and the components of hard hat 200 have been given the same reference number plus 100.

Brim 226 of hard hat 200 extends around all of bottom segment 224 (i.e., brim 226 is a full brim). A rear brim portion 278 of brim 226 extends radially outward from a portion of the lower circumference of hard hat 200. In a specific embodiment, rear brim portion 278 extends radially outward from the rear 268 of hard hat 200 a distance greater than a distance brim 226 extends radially from the front 228 of outer shell 212.

As previously discussed, the hard hat designs discussed herein are designed to provide improved rotational impact performance while meeting wearer demands unique to a construction or work environment (weight, comfort, etc.) allowing a user to wear the hard hat for a significant amount of time (i.e., large portion of the work day).

Figure 8:
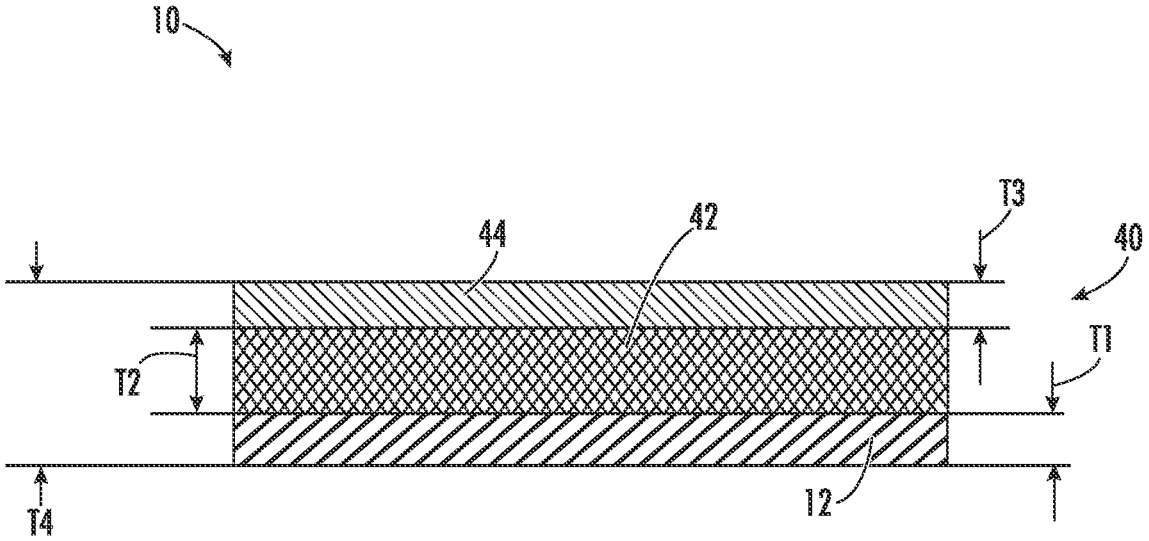
FIG. 8 is a partial cross-sectional view of the hard hat of FIG. 1, according to an exemplary embodiment.

Referring to FIG. 8, a partial cross-sectional view of hard hat 10 and impact absorbing insert 40 at the crown portion 22 of hard hat 10 is shown schematically. Applicant has determined that the hard hat design discussed herein allows for an improved impact performance. Outer shell 12 has a thickness, T1. In various embodiments, the outer shell 12 has a maximum wall thickness T1. In various embodiments, the wall thickness T1 is less than a maximum wall thickness.

In some embodiments, the total weight of the hard hat 10 includes the outer shell, the linear impact absorbing layer 42 and the rotational impact absorbing layer 44. In a specific embodiment, the total weight of hard hat 10 is less than a maximum total weight of hard hat 10. In some embodiments the total weight of the hard hat 10 is less than 20 ounces and more specifically between about 18.5 and 15 ounces (i.e., 18.5 ounces plus or minus 0.5 ounces and 15 ounces plus or minus 0.5 ounces). In some embodiments, the total weight of hard hat 10 is between 10 and 20 ounces and more specifically between 13 and 20 ounces. As will be generally understood, hard hat 10 generally has a weight less than a weight of a football or race car helmet, while having a weight generally greater than a bike helmet which typically weighs 10 to 12 ounces.

In some embodiments the total weight of the outer shell 12 is less than a maximum weight. In such embodiments, the hard hat shell has these thicknesses and/or weights while providing one or more of the structural characteristics discussed herein. Applicant believes the design of the wall thicknesses and/or weight allows for the hard hat to provide a high level of impact protection while at the same time allowing for more user comfort, which is particularly important in the context of a protective work helmet/hard hat in which user may wear the device for many hours spanning a workday/shift. Further Applicant believes the hard hat designs discussed herein provide increased ventilation (reducing air temperature near a user's head), maintain a center of mass close to a center of the wearer's head, reduce hard hat weight and therefore neck and/or back fatigue, reduce pressure points on a wearer's head, and allow for additional accessories to be worn simultaneously.

In a specific embodiment, the total weight of the hard hat 10 includes the outer shell, the linear impact absorbing layer 42 and the rotational impact absorbing layer 44. In a specific embodiment, the total weight of hard hat 10 is less than a maximum total weight of hard hat 10.

In a specific embodiment, linear impact absorbing layer 42 has a thickness, T2. In a specific embodiment, linear impact absorbing layer 42 has a thickness, T2. In various embodiments, T2 is less than a maximum linear impact absorbing layer 42 thickness.

In a specific embodiment, rotational impact absorbing layer 44 has a thickness, T3. In various specific embodiments, T3 is less than T2. In various specific embodiments, the linear impact absorbing layer 42 has a first thickness and the rotational impact absorbing liner 44 has a second thickness. In such an embodiment the first thickness is different than the second thickness. In such an embodiment the second thickness is less than the first thickness.

In a specific embodiment, rotational impact absorbing layer 44 has a thickness, T3, of less than 10 mm, less than 8 mm, and specifically has a thickness between 2 mm to 8 mm, and more specifically between 4 mm to 6 mm. In a specific embodiment, T3 is about 6 mm (i.e., 6 mm±0.4 mm). In a specific embodiment, T3 is about 4 mm (i.e., 4 mm±0.1 mm). In various embodiments, an average thickness of rotational impact absorbing layer 44 less than 8 mm.

In various embodiments, a thickness of rotational impact absorbing layer 44 positioned at crown portion 22 is less than a thickness of rotational impact absorbing layer 44 positioned near bottom segment 24. In a specific embodiment, the thickness of rotational impact absorbing layer 44 positioned at crown portion 22 is about 4 mm (i.e., 4 mm plus or minus 0.1 mm) and the thickness of rotational impact absorbing layer 44 positioned near bottom segment 24 is about 6 mm (i.e., 6 mm plus or minus 0.2 mm).

In a specific embodiment, the thickness of rotational impact absorbing layer 44 positioned at crown portion 22, is different than a thickness of rotational impact absorbing layer 44 at the side or near bottom segment 24, the thickness of rotational impact absorbing layer 44 positioned near front 28, and the thickness of rotational impact absorbing layer 44 near rear portion 68 of hard hat 10. In such an embodiment, the thickness of rotational impact absorbing layer 44 positioned at crown portion 22 is about 4 mm (i.e., 4 mm plus or minus 0.1 mm), the thickness of rotational impact absorbing layer 44 at the side or near bottom segment 24 is about 5.66 mm (i.e., 5.66 mm plus or minus 0.1 mm), the thickness of rotational impact absorbing layer 44 positioned near front 28 is about 5.66 mm (i.e., 5.66 mm plus or minus 0.1 mm), and the thickness of rotational impact absorbing layer 44 near rear portion 68 of hard hat 10 is about 5.8 mm (i.e., 5.8 mm plus or minus 0.1 mm).

In specific embodiments, a total thickness of hard hat 10 at the crown portion 22 (inclusive of all of the outer shell 12 and the impact absorbing insert 40, i.e., T1+T2+T3) is T4. In specific embodiments, the total thickness, T4, of hard hat 10 at the crown portion 22 (inclusive of all of the outer shell 12 and the impact absorbing insert 40, i.e., T1+T2+T3) is less than a maximum total thickness of hard hat 10.

As previously mentioned, Applicant believes the hard hat designs discussed herein provide improved impact protection due to a reduction of peak rotational acceleration and/or combined linear acceleration and peak rotational acceleration reduction such that the risk and/or likelihood or injury to the hard hat wearer is reduced. Applicant determined the differences in peak rotational acceleration and linear acceleration through testing the hard hat designs discussed herein, alternative hard hat designs from Milwaukee Electric Tool Corporation labeled as 1 piece prototype and 3 piece prototype that are not currently commercially available and other available hard hats. Testing was performed using a Rheon Test Method as described in "The traumatic brain injury mitigation effects of a new viscoelastic add-on liner," as published by Scientific Reports (Siegkas, P., Sharp, D. J. & Ghajari, M. The traumatic brain injury mitigation effects of a new viscoelastic add-on liner. *Sci Rep* 9, 3471 (2019)), which is incorporated in herein by reference in its entirety. All samples were tested using a velocity of impact of 6.5 m/s, with an impact anvil angle of 45 degrees, and three impact locations (front side 70, side 72, rear side 74) described herein. Additionally, various impact performance tests performed using the Virginia Tech Method of impact testing as described in "Star Methodology for Bicycle Helemts," as published by Virginia Tech (Megan L. Bland, Craig McNally, Steven Rowson, Star Methodology for Bicycle Helmets, Virginia Tech http s://vtechworks.lib.vt-.edu/bitstream/handle/10919/83760/ Bicycle%20STAR%20Methodology.pdf?sequence=l&isAllowed=y) which is incorporated herein by reference in its entirety. All samples tested under the Virginia Tech Method were tested using a velocity of impact of 6.5 m/s, with an impact anvil angle of 45 degrees, and three impact locations (front side 70, side 72, rear side 74) described herein.

Test Examples

Figure 9:
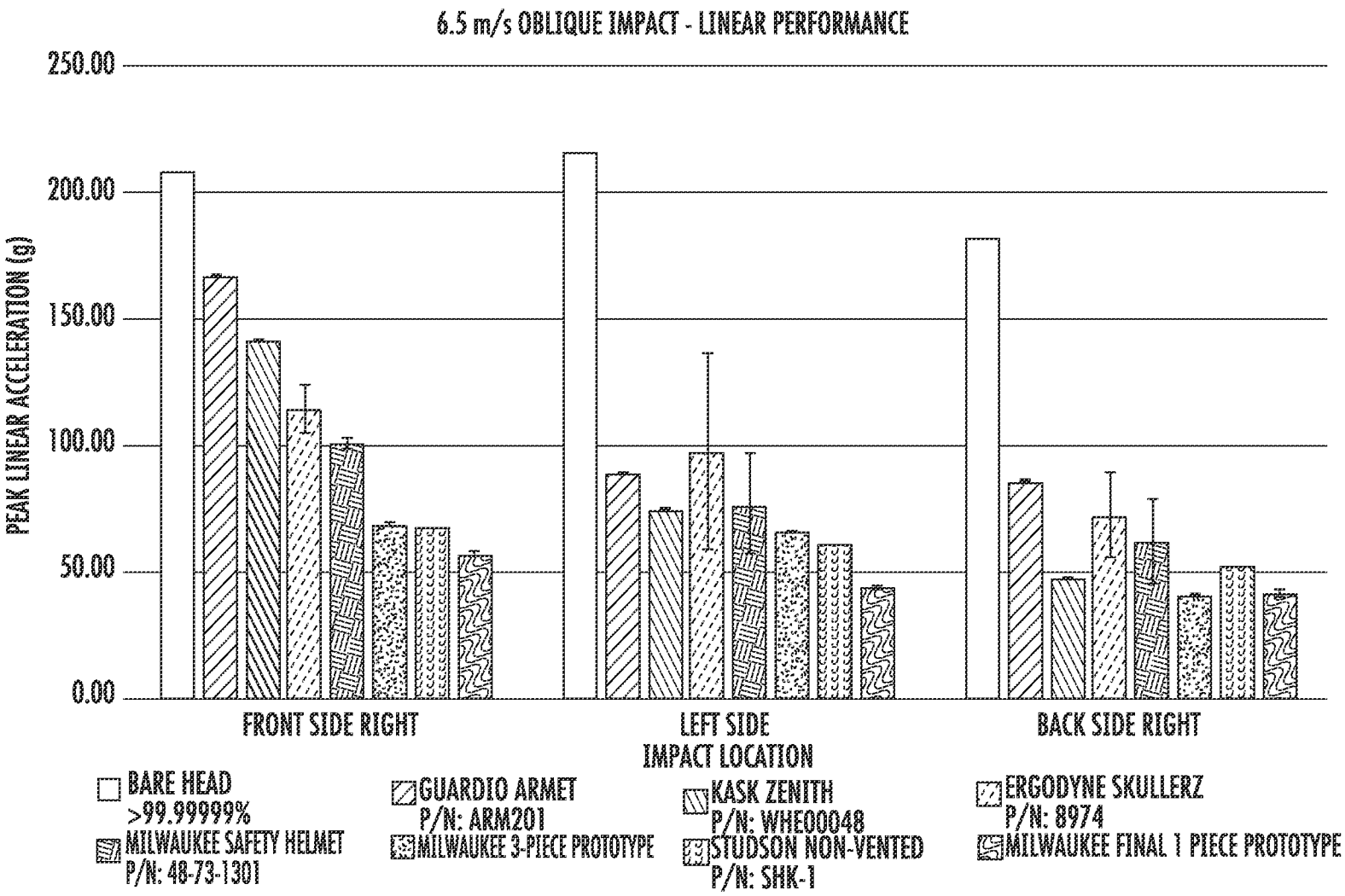
FIG. 9 is a plot showing the linear acceleration data of the hard hat of FIG. 1 compared to conventional hard hat samples after testing using the Rheon test method.

Referring to FIG. 9, a plot showing the peak linear acceleration of the hard hat designs discussed herein is shown compared against various conventional hard hat designs after testing using the Rheon Test Method. In a specific embodiment, the hard hat designs discussed herein have a peak linear acceleration under the Rheon Test Method less than a peak linear acceleration of various conventional hard hats when tested at front right location 70, side left location 72, and/or back side right location 74. In such embodiments, the peak linear acceleration is less than a maximum peak linear acceleration.

In a specific embodiment, the peak linear acceleration under the Rheon Test Method is less than 70 meters/second$^2$ at the front right location 70, less than 70 meters/second$^2$ at side left location 72, and less than 50 meters/second$^2$ at the back right location 74. In a specific embodiment, when rotational impact absorbing liner 44 is formed from three pieces, the peak linear acceleration under the Rheon Test Method is less than 70 meters/second$^2$ at the front right location 70, less than 70 meters/second$^2$ at side left location 72, and less than 40 meters/second at the back right location 74.

In a specific embodiment, when rotational impact absorbing liner 44 is formed from one piece, the peak linear acceleration under the Rheon Test Method is less than 65 meters/second$^2$ at the front right location 70, less than 50 meters/second$^2$ at side left location 72, and less than 50 meters/second$^2$ at the back right location 74. In a specific embodiment, when rotational impact absorbing liner 44 is formed from one piece, the peak linear acceleration under the Rheon Test Method is less than 60 meters/second$^2$ at the front right location 70, less than 45 meters/second$^2$ at side left location 72, and less than 45 meters/second$^2$ at the back right location 74.

Figure 10:
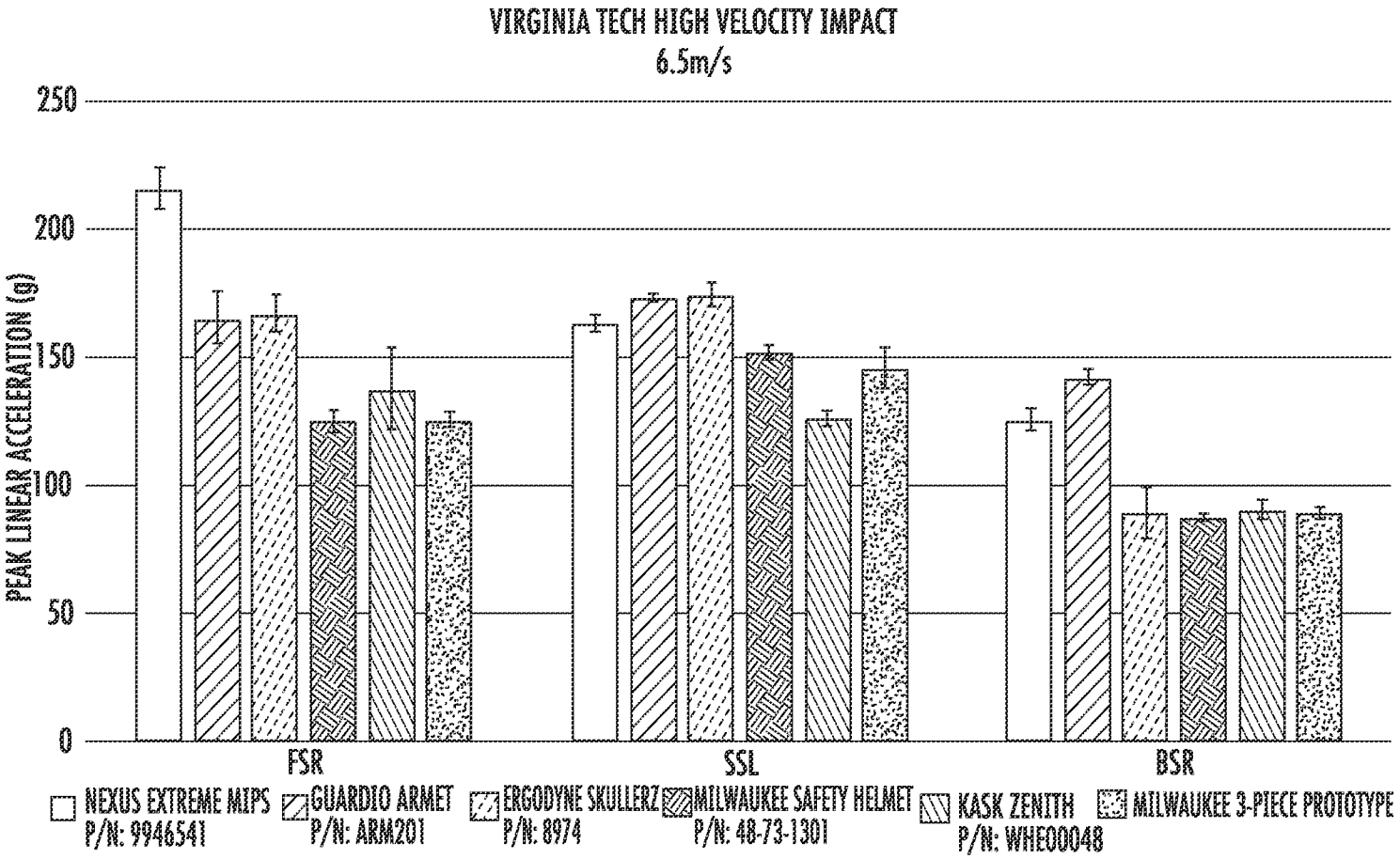
FIG. 10 is a plot showing the linear acceleration data of the hard hat of FIG. 1 compared to conventional hard hat samples after testing using the Virginia Tech test method.

Referring to FIG. 10, a plot showing the peak linear acceleration of the hard hat designs discussed herein is shown compared against various conventional hard hat designs after testing using the Virginia Tech Test Method. In a specific embodiment, the hard hat designs discussed herein have a peak linear acceleration under the Virginia Tech Test Method less than a peak linear acceleration of various conventional hard hats when tested at front right location 70 and/or back side right location 74. In such embodiments, the peak linear acceleration is less than a maximum peak linear acceleration.

In a specific embodiment, the peak linear acceleration under the Virginia Tech Test Method is less than 130 meters/second$^2$ at the front right location 70, less than 145 meters/second$^2$ at side left location 72, and less than 90 meters/second$^2$ at the back right location 74. In a specific embodiment, when rotational impact absorbing liner 44 is formed from three pieces, the peak linear acceleration under the Virginia Tech Test Method is less than 130 meters/second$^2$ at the front right location 70, less than 145 meters/second$^2$ at side left location 72, and less than 90 meters/second$^2$ at the back right location 74.

Figure 11:
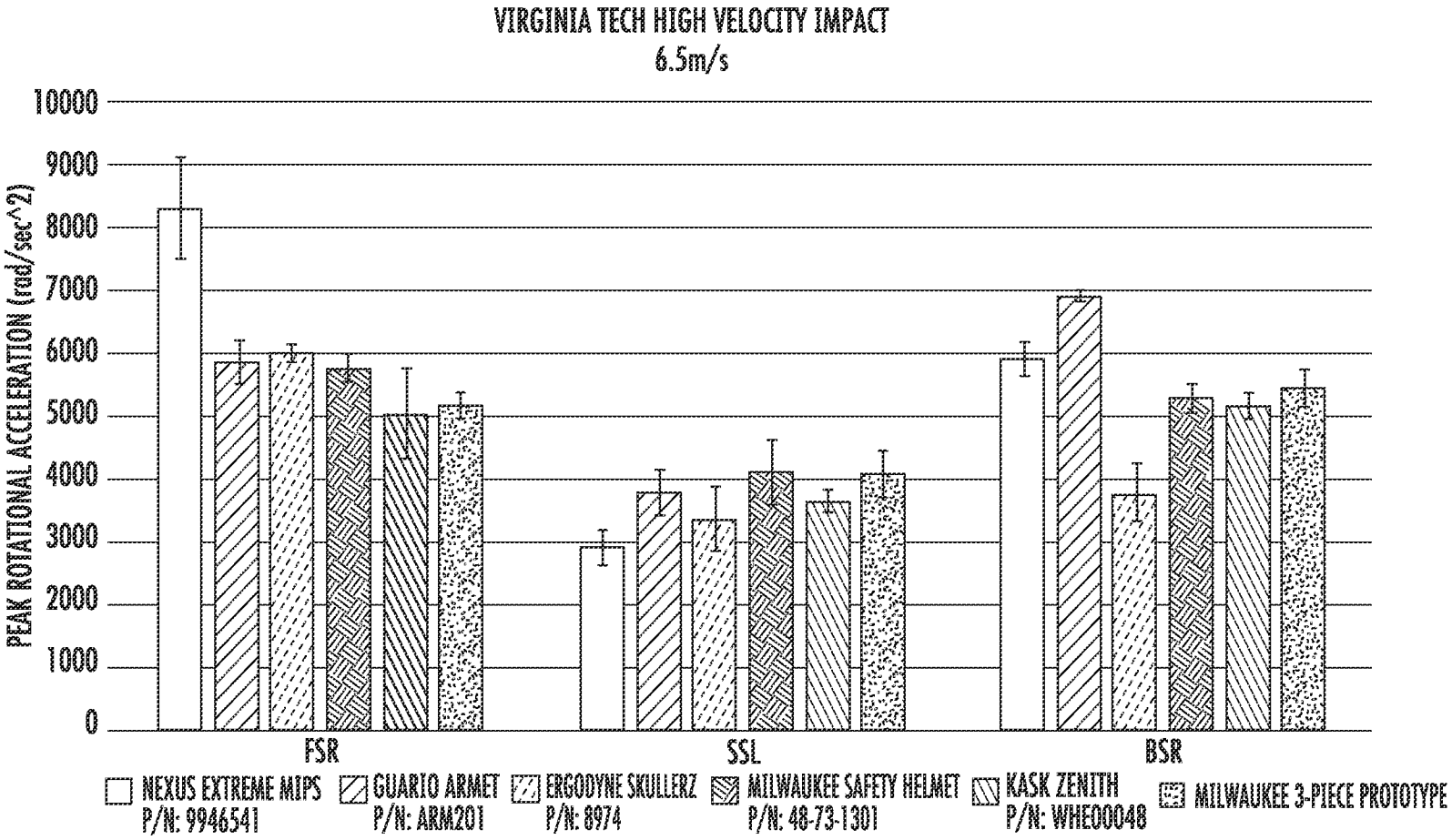
FIG. 11 is a plot showing the rotational acceleration data of the hard hat of FIG. 1 compared to conventional hard hat samples after testing using the Virginia Tech Test method.

Referring to FIG. 11, a plot showing the peak rotational acceleration of the hard hat designs discussed herein is shown compared against various conventional hard hat designs after testing using the Virginia Tech Test Method. In a specific embodiment, the hard hat designs discussed herein have a peak rotational acceleration under the Virginia Tech Test Method less than a peak rotational acceleration of some of the various conventional hard hats when tested at front right location 70, side left location 72, and/or back side right location 74. In such embodiments, the peak rotational acceleration is less than a maximum peak rotational acceleration.

In a specific embodiment, the peak rotational acceleration under the Virginia Tech Test Method at the front right location 70 is less than 5500 radians/second$^2$ and more specifically less than 5200 radians/second$^2$. In a specific embodiment, the peak rotational acceleration under the Virginia Tech Test Method at the side left location 72 is less than 4500 radians/second$^2$ and more specifically less than 4200 radians/second$^2$. In a specific embodiment, the peak rotational acceleration under the Virginia Tech Test Method at the back right side location 74 is less than 5500 radians/second$^2$.

In a specific embodiment, the peak rotational acceleration under the Virginia Tech Test Method is less than 5500 radians/second$^2$. In such an embodiment, the peak rotational acceleration under the Virginia Tech Test Method is greater than 4000 radians/second$^2$. In other words, the peak rotational acceleration under the Virginia Tech Test Method is between 4000 radians/second$^2$ and 5500 radians/second$^2$. In various specific embodiments, the peak rotational acceleration under the Virginia Tech Test Method at the front right location 70, at the side left location 72, and the back right side location 74 are all between 4000 radians/second$^2$ and 5500 radians/second$^2$.

Figure 12:
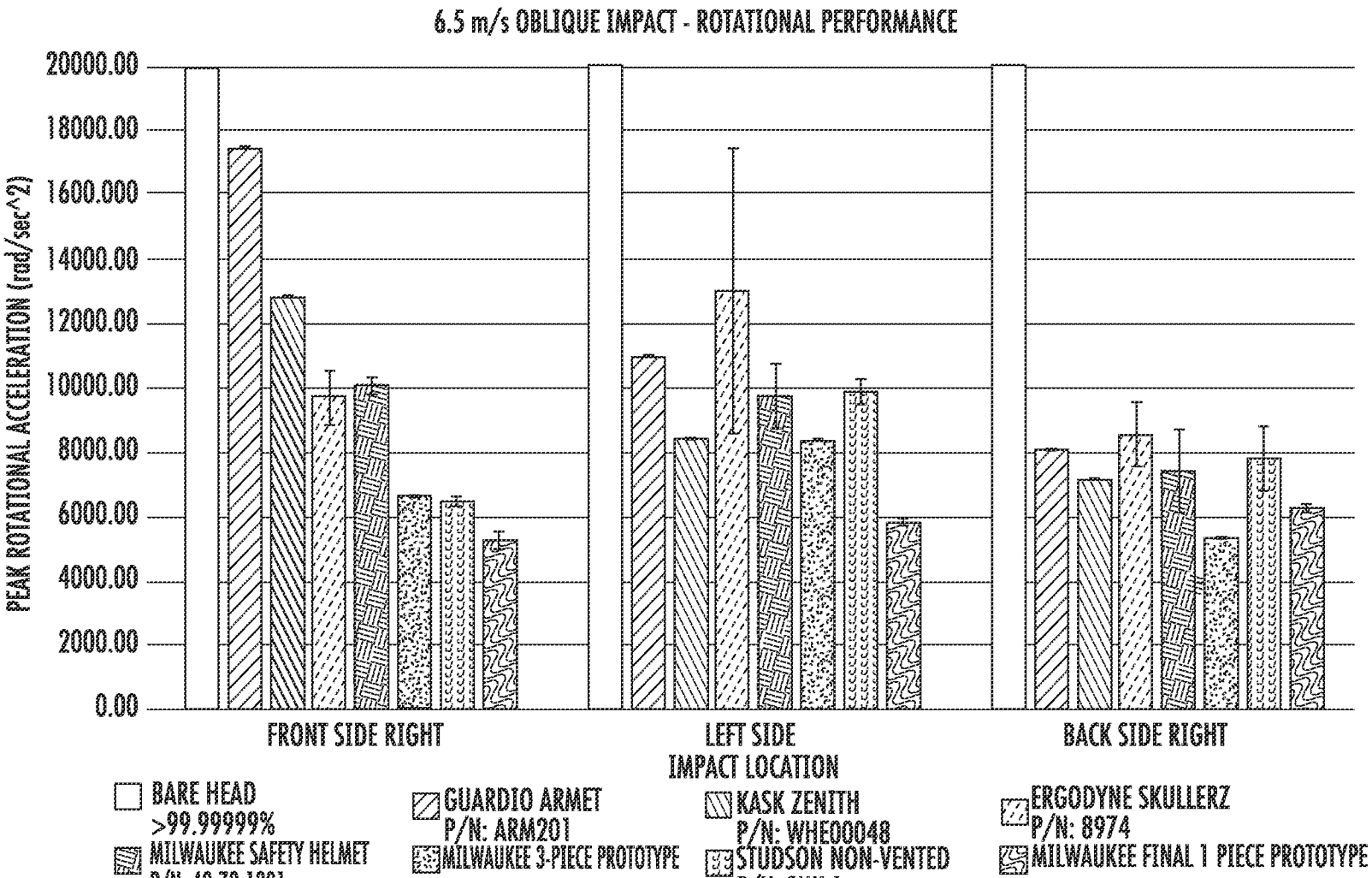
FIG. 12 is a plot showing the rotational acceleration data of the hard hat of FIG. 1 compared to conventional hard hat samples after testing using the Rheon Test method.

Referring to FIG. 12, a plot showing the peak rotational acceleration of the hard hat designs discussed herein is shown compared against various conventional hard hat designs after testing using the Rheon Test Method. In a specific embodiment, the hard hat designs discussed herein have a peak rotational acceleration under the Rheon Test Method less than a peak rotational acceleration of various conventional hard hats when tested at front right location 70, side left location 72, and/or back side right location 74. In such embodiments, the peak rotational acceleration is less than a maximum peak linear acceleration.

In a specific embodiment, the peak rotational acceleration at the front right location 70 is less than 7000 radians/second$^2$. In a specific embodiment, the peak rotational acceleration at the side left location 72 is less than 9000 radians/second$^2$. In a specific embodiment, the peak rotational acceleration at the back right side location 74 is less than 7000 radians/second$^2$. In another specific embodiment, the peak rotational acceleration at the front right location 70 is less than 7000 radians/second$^2$, the peak rotational acceleration at the side left location 72 is less than 8500 radians/second$^2$, and the peak rotational acceleration at the back right side location 74 is less than 6500 radians/second$^2$.

In a specific embodiment, when rotational impact absorbing liner 44 is formed from three pieces, the peak rotational acceleration at the front right location 70 is less than 7000 radians/second$^2$. In a specific embodiment, the peak rotational acceleration at the side left location 72 is less than 9000 radians/second$^2$. In another specific embodiment, the peak rotational acceleration at the side left location 72 is less than 8500 radians/second$^2$. In a specific embodiment, the peak rotational acceleration at the back right side location 74 is less than 6000 radians/second$^2$. In another specific embodiment, the peak rotational acceleration at the back right side location 74 is less than 5500 radians/second$^2$. In various embodiments, the peak rotational acceleration at the front right location 70 is less than 7000 radians/second$^2$, the peak rotational acceleration at the side left location 72 is less than 8500 radians/second$^2$, and be peak rotational acceleration at the back right side location 74 is less than 5500 radians/second$^2$.

In a specific embodiment, when rotational impact absorbing liner 44 is formed from one piece, the peak rotational acceleration at the front right location 70 is less than 6000 radians/second$^2$. In a specific embodiment, the peak rotational acceleration at the side left location 72 is less than 6000 radians/second$^2$. In a specific embodiment, the peak rotational acceleration at the back right side location 74 is less than 6500 radians/second$^2$. In a specific embodiment, the peak rotational acceleration under the Rheon Test Method is less than 7000 radians/second$^2$. In such an embodiment, the peak rotational acceleration under the Rheon Test Method is greater than 5000 radians/second$^2$. In other words, the peak rotational acceleration under the Rheon Test Method is between 5000 radians/second$^2$ and 7000 radians/second$^2$. In various specific embodiments, the peak rotational acceleration under the Rheon Test Method at the front right location 70, at the side left location 72, and the back right side location 74 are all between 5000 radians/second$^2$ and 7000 radians/second$^2$.

Applicant has believes that the hard hats discussed herein does not require a large slip plane and/or displacement to absorb impact energy unlike conventional hard hats that rely on large amounts of translation and/or sliding movement (i.e., 10-15 mm). As previously mentioned, Applicant believes impact systems that rely on large slips planes for translation and/or movement have a time delay between impact and when the translation begins and therefore a delay between impact and when energy is being absorbed. Applicant believes the hard hat and rotational impact layer can reduce the rotational acceleration experienced by the helmet wearer with less translating and/or sliding movement. Applicant believes an amount of translation and/or sliding movement, S, of inner surface 54 of rotational absorbing layer 44 relative to the linear impact absorbing layer 42 is reduced. In various embodiments, the translation and/or sliding movement S of rotational absorbing layer 44 is less than a maximum translation distance.

Figure 13:
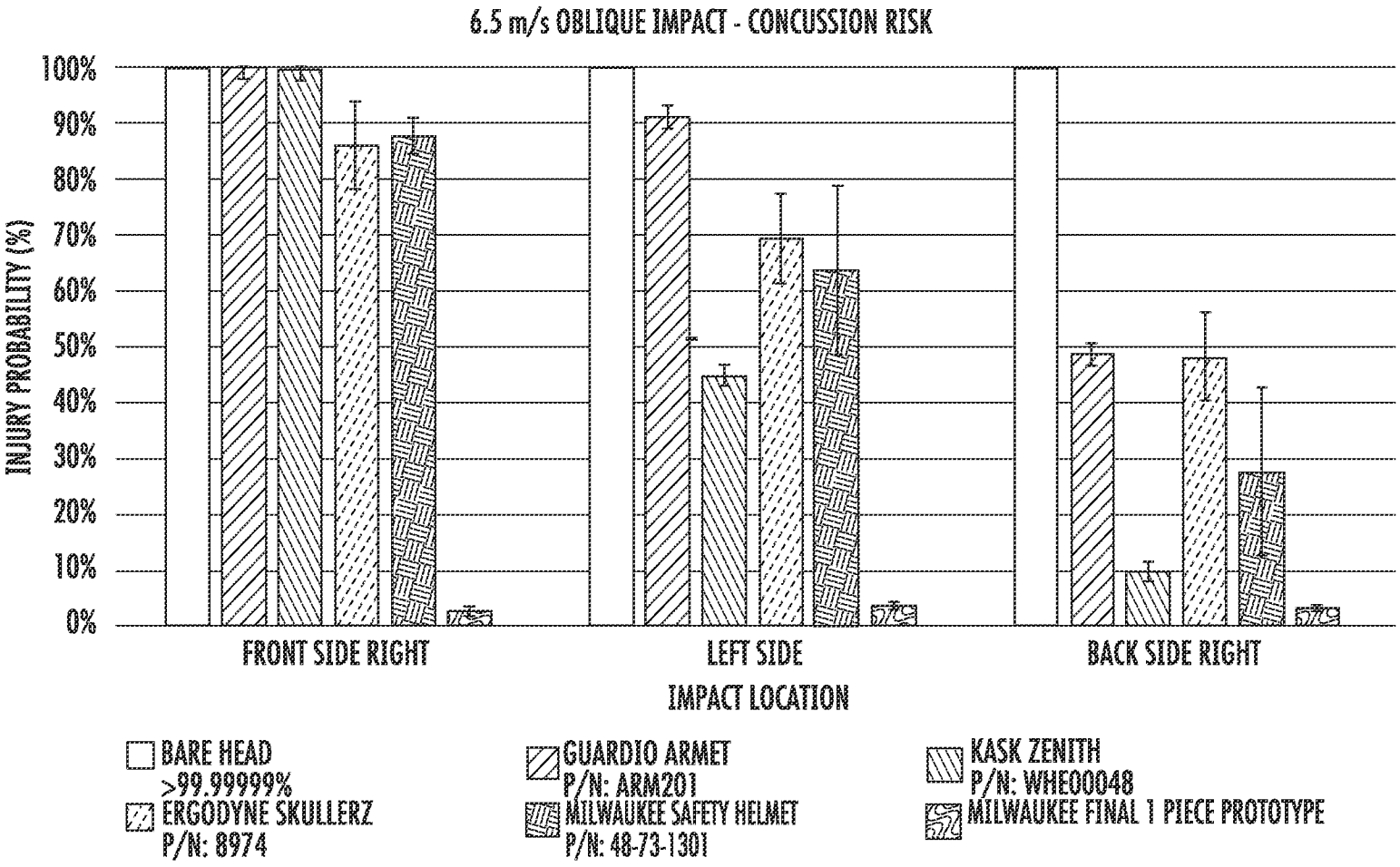
FIG. 13 is a plot of the injury probability of the hard hat of FIG. 1 compared to conventional hard hat samples after testing using the Rheon Test Method.
Figure 14:
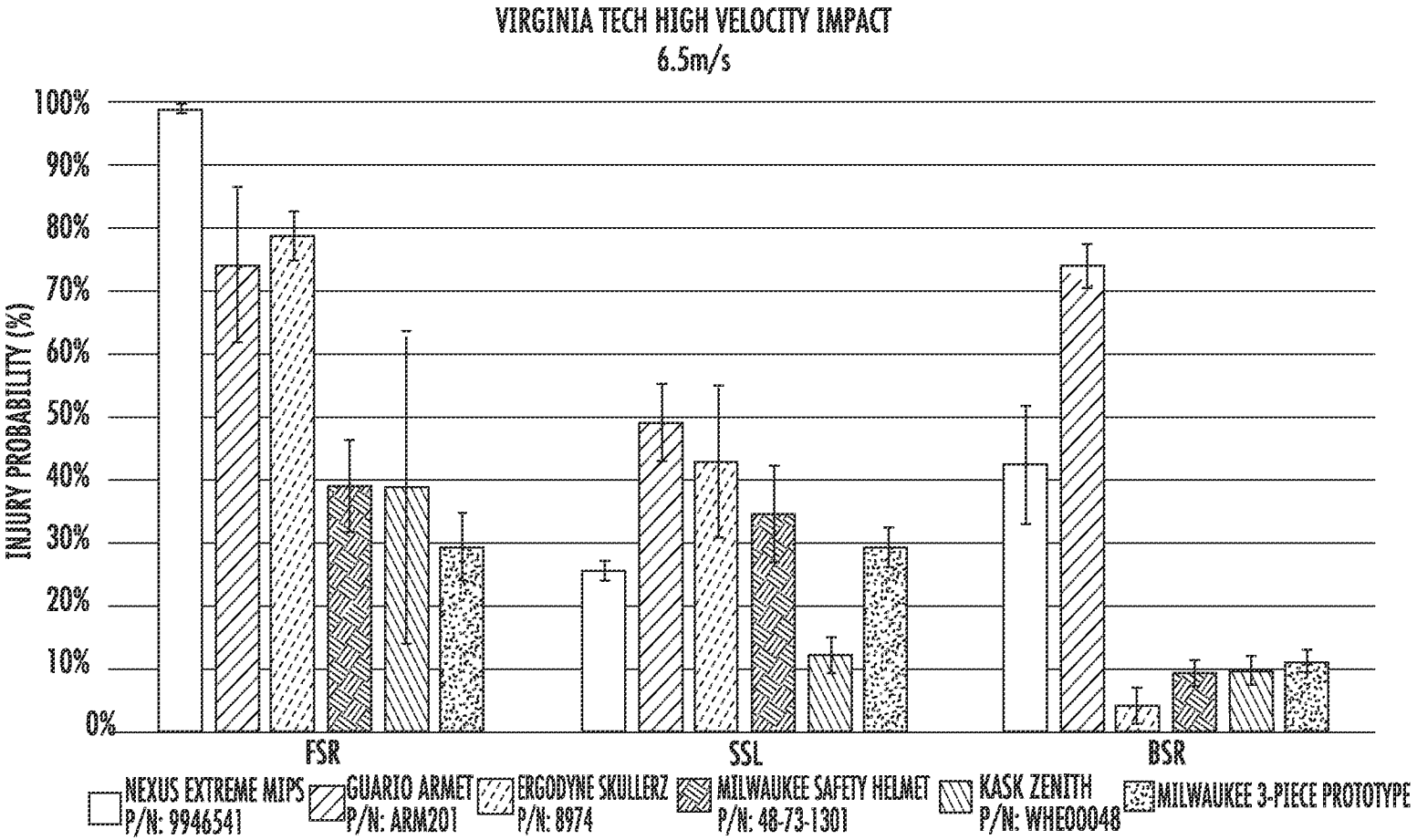
FIG. 14 is a plot of the injury probability of the hard hat of FIG. 1 compared to conventional hard hat samples after testing using the Virginia Tech Test Method.

Applicant believes the hard hat designs discussed herein provide a reduction in the amount of impact and/or energy experienced by the wearer and therefore reducing the likelihood of injury as demonstrated in FIGS. 13-14.

Referring to FIG. 13, a plot showing the injury probability or concussion risk of the hard hat 10 design is shown compared against a bare head and four conventional hard hat designs based on the Rheon Test Method described above. Applicant has calculated the concussion risk using the formula:

$$CP = \frac{1}{1 + e^{-(-10.2+0.0433\cdot\alpha+0.000873\cdot a-0.000000920\cdot\alpha a)}}$$

In the concussion risk formula, α is equal to rotational acceleration (rad/s$^2$) and a is equal to the linear acceleration (g).

In various embodiment, the hard hat designs discussed herein have a reduced injury probability under the Rheon Test Method compared to an injury probability of conventional hard hats when tested at front right location 70, side left location 72, and/or back side right location 74. In such embodiments, the injury probability is less than a maximum injury probability. In a specific embodiment, the injury probability is reduced between 70% and 90%, specifically between 80% and 90% and more specifically about 84% compared to a conventional hard hat design when tested at front right location 70. In a specific embodiment, the injury probability is reduced between 50% and 70%, specifically between 55% and 65% and more specifically about 59% compared to a conventional hard hat design when tested at side left location 72. In a specific embodiment, the injury probability is reduced between 15% and 35%, specifically between 20% and 30% and more specifically about 24% compared to a conventional hard hat design when tested at back side right location 74.

Referring to FIG. 14, a plot showing the injury probability or concussion risk of the hard hat 10 design is shown compared against a bare head and four conventional hard hat designs based on the Virginia Tech Test Method described above. In various embodiment, the hard hat designs discussed herein have a reduced injury probability under the Virginia Tech Test Method compared to an injury probability of various conventional hard hats when tested at front right location 70, side left location 72, and/or back side right location 74.

In such embodiments, the injury probability is less than a maximum injury probability. In a specific embodiment, the injury probability is reduced between 5% and 20%, specifically between 8% and 15% and more specifically about 11% compared to a conventional hard hat design when tested at front right location 70.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A protective work helmet, comprising:
an outer shell, the outer shell comprising:
an exterior surface;
an interior surface defining a cavity sized to receive a head of a user;
a crown portion configured to cover part of the head of the user, wherein a bottom segment of the crown portion defines a lower circumference extending along the exterior surface of the outer shell;
a brim extending radially outward from a portion of the lower circumference; and
a front mounting ridge configured to couple an accessory to the protective work helmet;
a linear impact absorbing material located within the outer shell; and
a rotational impact absorbing material located within the outer shell, the rotational impact absorbing material comprises a strain rate sensitive material, wherein the rotational impact absorbing material has a first rigidity, and wherein the rotational impact absorbing material has a second rigidity upon impact, the second rigidity is greater than the first rigidity.

2. The protective work helmet of claim 1, wherein the rotational impact absorbing material is a unitary piece of polymer material comprising a plurality of cells coupled to an inner surface of the linear impact absorbing material.

3. The protective work helmet of claim 1, wherein the linear impact absorbing material is a polymer foam material having an outer surface coupled to the interior surface of the outer shell.

4. The protective work helmet of claim 1, wherein a total weight of the protective work helmet is less than 20 ounces.

5. The protective work helmet of claim 4, wherein the total weight of the protective work helmet is between 13 and 20 ounces.

6. The protective work helmet of claim 1, further comprising a mounting ridge coupled to a lateral side of the bottom segment of the crown portion, the mounting ridge comprising:
a first end;
a second end; and
a plurality of slots positioned along the mounting ridge between the first end and the second end.

7. A protective work helmet comprising:
an outer shell formed from a rigid material, the outer shell comprising:
an exterior surface;
an interior surface defining a cavity sized to receive a head of a user;
a crown portion configured to cover part of the head of the user, wherein a bottom segment of the crown portion defines a lower circumference extending along the exterior surface of the outer shell;
a brim extending radially outward from a portion of the lower circumference; and
a polymer foam insert located within the outer shell and having a thickness, the polymer foam insert comprising:
an outer surface facing the interior surface of the outer shell; and
an inner surface facing inward; and
a rotational impact absorbing liner coupled to the inner surface of the polymer foam insert, the rotational impact absorbing liner comprises a strain rate sensitive material, wherein the rotation impact absorbing liner has a first rigidity, and wherein the rotational impact absorbing liner has a second rigidity upon impact, the second rigidity is greater than the first rigidity.

8. The protective work helmet of claim 7, wherein the rotational impact absorbing liner has a thickness less than 8 mm.

9. The protective work helmet of claim 8, wherein the rotational impact absorbing liner has a thickness between 2 mm and 8 mm.

10. The protective work helmet of claim 7, wherein the polymer foam insert has a first thickness and the rotational impact absorbing liner has a second thickness, and wherein the first thickness is different than the second thickness.

11. The protective work helmet of claim 10, wherein the second thickness is less than the first thickness.

12. A protective work helmet, comprising:
an outer shell, the outer shell comprising:
an exterior surface;
an interior surface defining a cavity sized to receive a head of a user;
a crown portion configured to cover part of the head of the user, wherein a bottom segment of the crown portion defines a lower circumference extending along the exterior surface of the outer shell;
a brim extending radially outward from a portion of the lower circumference; and
a front mounting ridge configured to couple an accessory to the protective work helmet; and an impact absorbing insert comprising:

a linear impact absorbing material positioned within the outer shell; and a rotational impact absorbing material positioned within the outer shell;

wherein the impact absorbing insert is configured to provide a peak rotational acceleration under a Rheon Test Method less than 7000 radians/second$^2$ upon impact.

13. The protective work helmet of claim 12, wherein the peak rotational acceleration under the Rheon Test Method is greater than 5000 radians/second$^2$.

14. The protective work helmet of claim 12, wherein the rotational impact absorbing material is a unitary piece of polymer material comprising a plurality of cells coupled to an inner surface of the linear impact absorbing material.

15. The protective work helmet of claim 12, wherein the rotational impact absorbing material has an average thickness less than 8 mm.

16. The protective work helmet of claim 12, wherein a thickness of a portion of the rotational impact absorbing material positioned at the crown portion is less than a thickness of the rotational impact absorbing material positioned near the bottom segment.

17. The protective work helmet of claim 16, wherein the thickness of the portion of the rotational impact absorbing material positioned at the crown portion is about 4 mm.

18. The protective work helmet of claim 16, wherein the thickness of the portion of the rotational impact absorbing material positioned near the bottom segment is about 6 mm.

19. The protective work helmet of claim 12, further comprising an auxiliary mounting ridge coupled to a lateral side of the bottom segment of the crown portion, the auxiliary mounting ridge comprising:

a first end;

a second end; and a plurality of slots positioned along the auxiliary mounting ridge between the first end and the second end.

20. The protective work helmet of claim 12, wherein the linear impact absorbing material has a first thickness and the rotational impact absorbing material has a second thickness, and wherein the second thickness is less than the first thickness.

21. A protective work helmet, comprising:

an outer shell, the outer shell comprising:

an exterior surface;

an interior surface defining a cavity sized to receive a head of a user;

a crown portion configured to cover part of the head of the user, wherein a bottom segment of the crown portion defines a lower circumference extending along the exterior surface of the outer shell;

a brim extending radially outward from a portion of the lower circumference; and a front mounting ridge configured to couple an accessory to the protective work helmet; and an impact absorbing insert comprising:

a linear impact absorbing material positioned within the outer shell;

a rotational impact absorbing material positioned within the outer shell;

wherein the impact absorbing insert is configured to provide a peak rotational acceleration under a Rheon Test Method less than 7000 radians/second$^2$ upon impact and wherein the impact absorbing insert is configured to provide a peak linear acceleration under the Rheon Test Method less than 70 meters/second$^2$ upon impact.

* * * * *